US006889797B2

(12) United States Patent
Cowgill et al.

(10) Patent No.: US 6,889,797 B2
(45) Date of Patent: May 10, 2005

(54) MULTI-PURPOSE HEADGEAR

(75) Inventors: John H. Cowgill, Neotsu, OR (US); Charles W. Elroy, Jr., Depoe Bay, OR (US)

(73) Assignee: Sportniks, Inc., Neotsu, OR (US)

( * ) Notice: Subject to any disclaimer, the term of this patent is extended or adjusted under 35 U.S.C. 154(b) by 62 days.

(21) Appl. No.: 10/421,237

(22) Filed: Apr. 21, 2003

(65) Prior Publication Data

US 2003/0196851 A1 Oct. 23, 2003

Related U.S. Application Data

(63) Continuation-in-part of application No. 09/995,078, filed on Nov. 26, 2001, now Pat. No. 6,568,504, and a continuation-in-part of application No. 29/173,412, filed on Dec. 28, 2002, now Pat. No. Des. 478,711, said application No. 09/995,078, filed on Nov. 26, 2001, and a continuation-in-part of application No. 29/138,100, filed on Mar. 6, 2001, now Pat. No. Des. 456,595.

(60) Provisional application No. 60/256,447, filed on Dec. 18, 2000.

(51) Int. Cl.[7] ..... G10K 11/00

(52) U.S. Cl. ..... 181/178

(58) Field of Search ..... 181/178, 175, 181/176, 179, 180, 182, 177, 186; 84/411 R

(56) References Cited

U.S. PATENT DOCUMENTS

| | | | | |
|---|---|---|---|---|
| 1,579,034 A | | 3/1926 | Roberts | |
| 1,736,109 A | | 11/1929 | Barton | |
| 2,617,298 A | | 11/1952 | Grinley | |
| 3,237,210 A | | 3/1966 | Graber | |
| 3,450,226 A | | 6/1969 | Kessler | |
| D215,622 S | | 10/1969 | Alaska | |
| 3,696,672 A | | 10/1972 | Lindsay | |
| D250,497 S | | 12/1978 | Rocheleau et al. | |
| 4,178,706 A | | 12/1979 | Boyce | |
| 4,286,463 A | | 9/1981 | Cole | |
| 4,329,905 A | * | 5/1982 | Lloyd | 84/411 R |
| D277,139 S | | 1/1985 | DeFalco | |
| 4,613,012 A | | 9/1986 | Mueller, III | |
| 4,641,380 A | | 2/1987 | Epstein | |
| 4,703,829 A | | 11/1987 | Hardt | |
| 4,730,488 A | | 3/1988 | David | |
| 5,172,506 A | | 12/1992 | Tiley | |
| D338,464 S | | 8/1993 | Darby | |
| D351,272 S | | 10/1994 | Hyer | |
| D393,739 S | | 4/1998 | Dudson et al. | |
| D402,090 S | | 12/1998 | Turocy | |
| 6,032,523 A | | 3/2000 | Smith | |
| 6,230,329 B1 | * | 5/2001 | Jennings | 2/114 |
| 6,282,721 B1 | | 9/2001 | Travalgla | |
| D456,595 S | | 5/2002 | Cowgill et al. | |
| 6,568,504 B2 | * | 5/2003 | Cowgill et al. | 181/178 |

* cited by examiner

*Primary Examiner*—Kimberly Lockett
(74) *Attorney, Agent, or Firm*—Marger Johnson & McCollom, PC

(57) ABSTRACT

A multi-purpose device for use in a wide variety of circumstances including at sporting events. The device can (1) serve as a hat or headgear, (2) it can amplify a user's voice, (3) it can be used as a hearing aid, (4) it can be used as a carrying utensil, (5) it can serve as a banner to advertise a logo, (6) it can be used as a traffic safety cone, and (7) it can serve as a Christmas ornament. The device is tubular in shape; however, the tube is larger at one end than at the other end. The small end is about the size of mouth piece and the large end is several times larger than the small end. The device is made of a soft material that can fold and the inside of the device has sound reflective properties. The device is made of flexible material that can support its own weight when held at the ends.

22 Claims, 10 Drawing Sheets

MULTI-PURPOSE HEADGEAR

RELATED APPLICATIONS

This application is a continuation-in-part of application Ser. No. 09/995,078 filed Nov. 26, 2001 now U.S. Pat. No. 6,568,504. This application is also a continuation-in-part of Ser. No. 29/173,412 filed Dec. 28, 2002 now U.S. Pat. No. 0,478,711. Application Ser. No. 09/995,078 is non-provisional application of provisional application No. 60/256,447 filed Dec. 18, 2000 and a continuation-in-part of application Ser. No. 29/138,100 filed Mar. 6, 2001 now U.S. Pat. No. 0,456,595.

Priority under 35 U.S.C. 119 and 35 U.S.C. 120 to the filing date of the above four listed applications is claimed. The descriptive material and drawings in the above four applications is hereby incorporated herein in their entirety by reference.

FIELD OF THE INVENTION

The present invention relates to clothing and more particularly to headgear and hats.

BACKGROUND OF THE INVENTION

Football and other sporting events are often played in adverse weather conditions, hence, a headgear is a very desirable accessory at sporting events. Sometimes a headgear is used for warmth. Other times it is used as a sun deflector.

Headgear worn at sporting events is often colorful and humorous. For example there are the well known cheese hats worn at football games in Wisconsin.

Noisemakers are also common at football games. However, when sitting in bleachers, such noisemakers often make it hard to hear announcements.

SUMMARY OF THE PRESENT INVENTION

The present invention provides a multi-purpose device for use in a wide variety of circumstances including at sporting events. The device can (1) serve as a hat or headgear, (2) it can amplify a user's voice, (3) it can be used as a hearing aid, (4) it can be used as a carrying utensil, (5) it can serve as a banner to advertise a logo, (6) it can be used as a traffic safety cone, and (7) it can serve as a Christmas ornament or stocking. The device is tubular in shape, however, the tube is tapered. That is, the tube is larger at one end than at the other end. The small end has an opening that is about the size of mouth piece and the opening at the large end is several times larger than the opening at the small end. The material that forms the main tubular body has sound reflecting properties. The device is made of a flexible material that can fold; however, when placed or held at the ends, the devise can support its own weight.

DETAILED DESCRIPTION OF EMBODIMENTS

A first embodiment of the invention is shown in FIGS. 1, 2, 3, 4, 6 and 8. The device has three sections, namely, a main body 10, a large end 11 and a small end 14.

Figure 1:
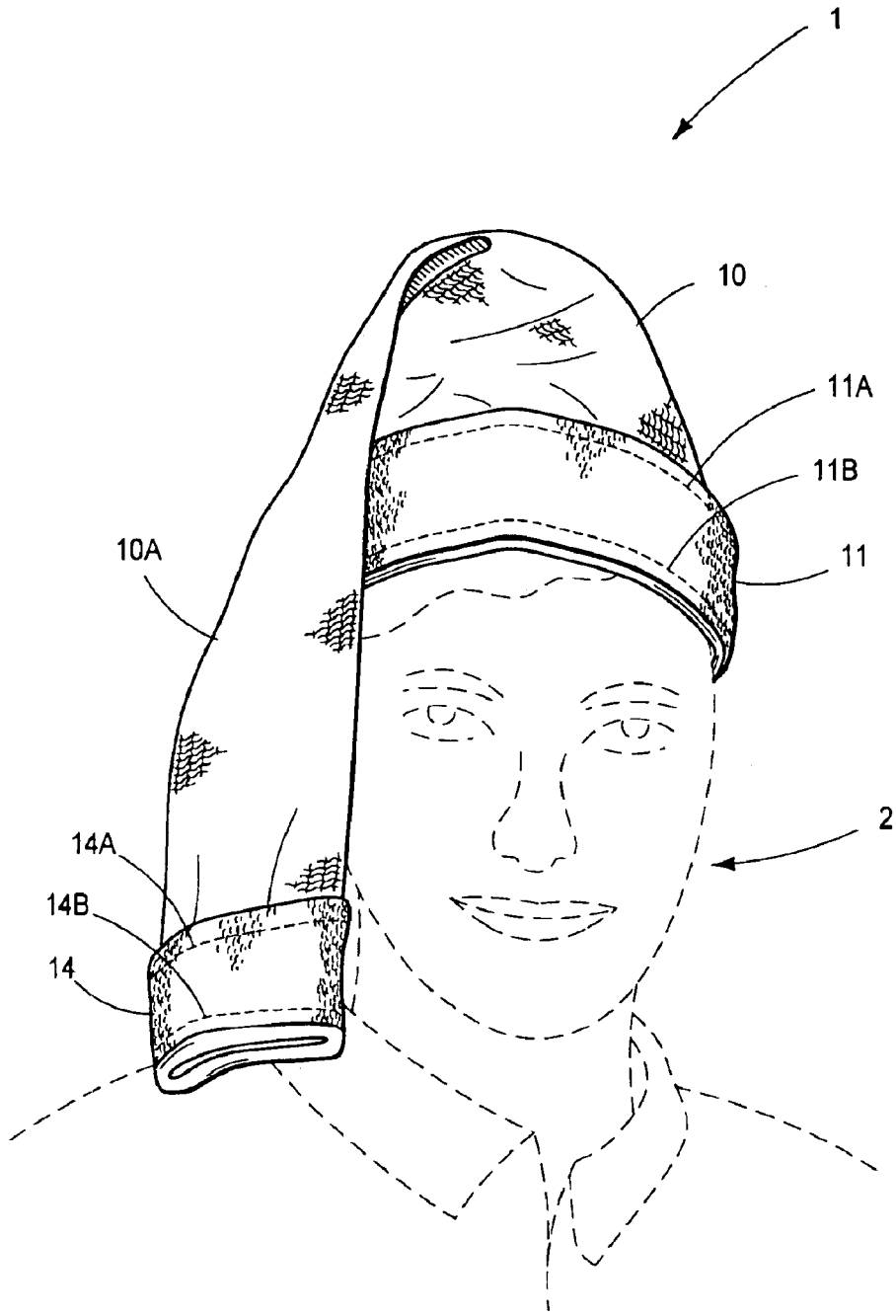
FIG. 1 illustrates a first embodiment of the invention being worn as a hat or headgear.
Figure 2:
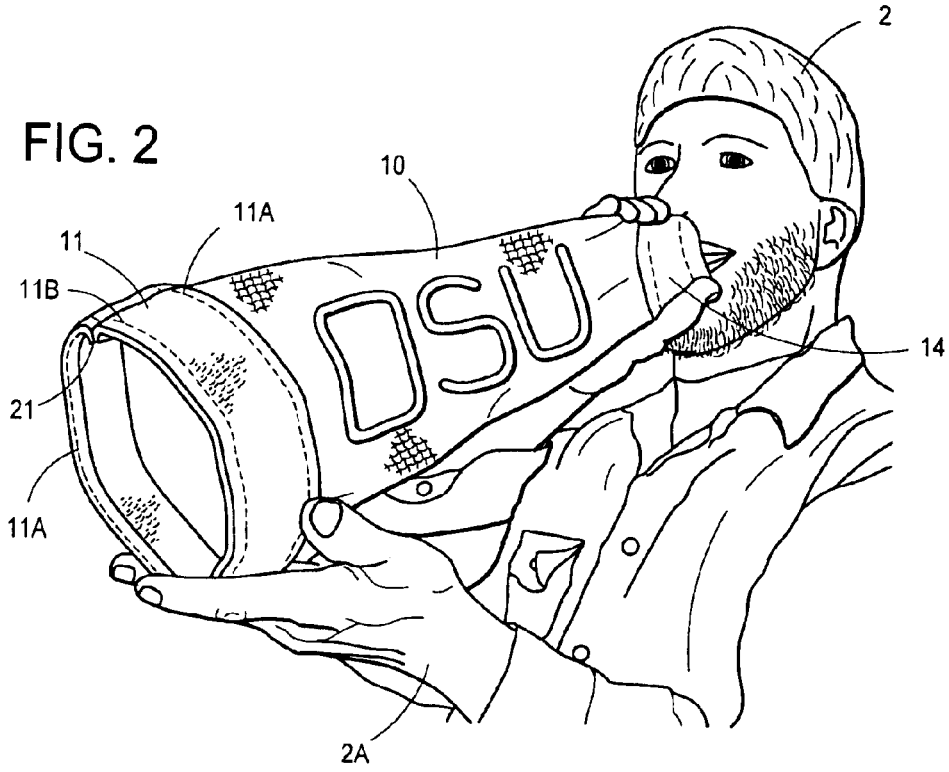
FIG. 2 illustrates the invention being used to amplify the user's voice.
Figure 3:
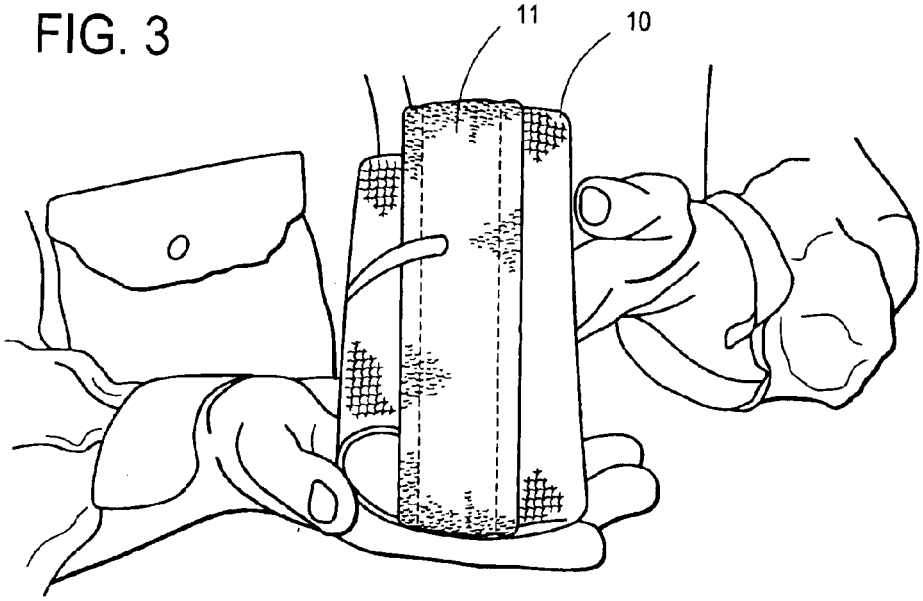
FIG. 3 illustrates the first embodiment in a folded configuration.
Figure 4:
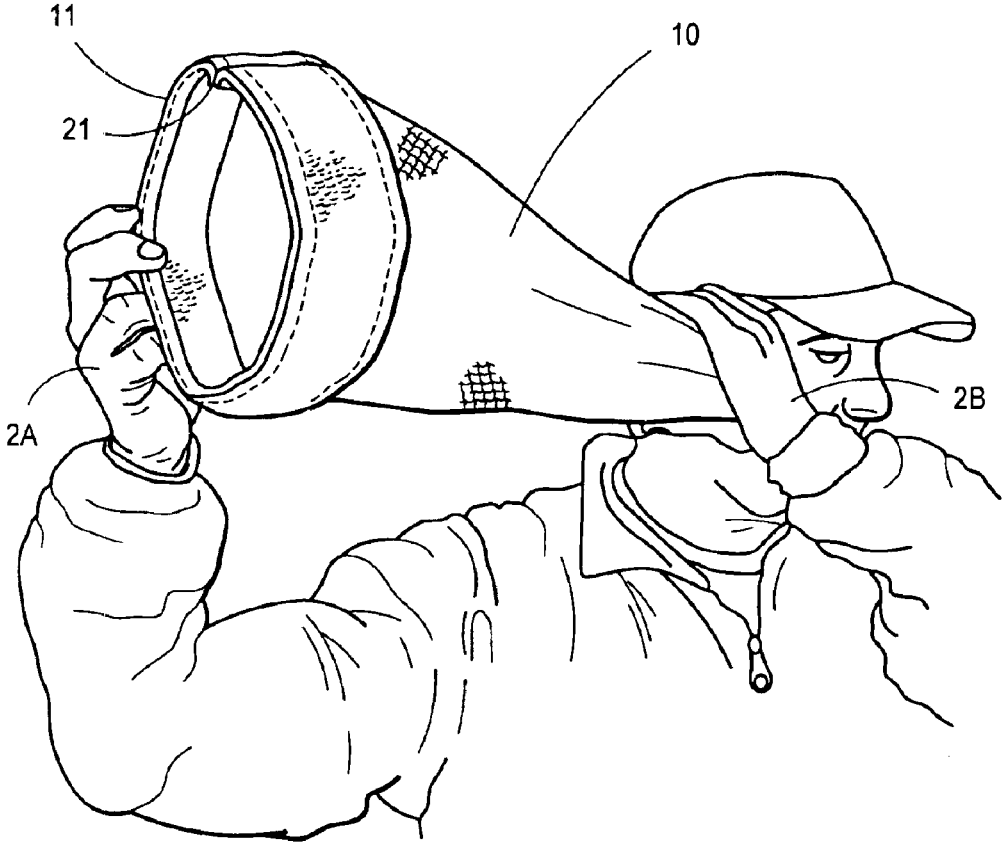
FIG. 4 illustrates the invention being used to enhance hearing ability.
Figure 6:
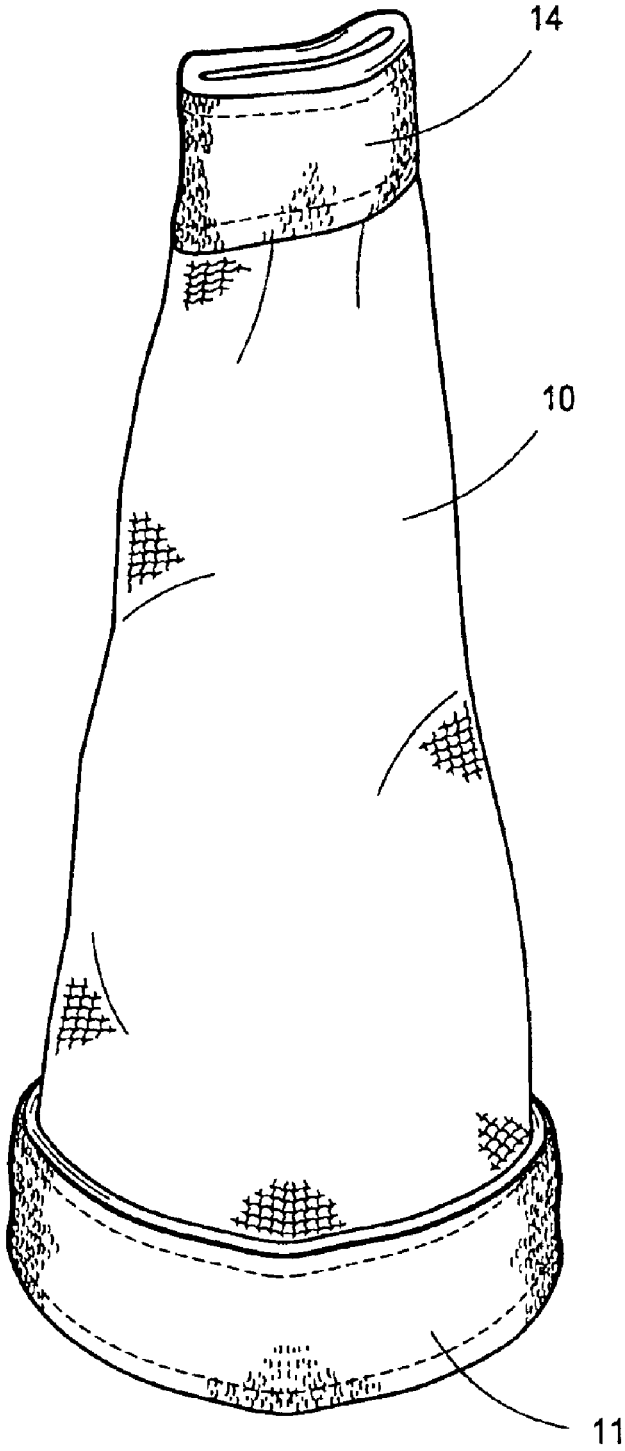
FIG. 6 illustrates the invention being used as a traffic safety cone.

FIG. 1 shows the device used as a hat. FIG. 2 shows the device used as a sound amplifying device. FIG. 3 shows the device folded so that it can be easily stored and carried. FIG. 4 shows the device used as a hearing aid. FIG. 6 shows the device used as a traffic safety cone.

When the first embodiment is held or placed as shown in FIGS. 2, 4 and 6, the device has the shape of a round tapered tube which has a small end and a large end. There is a cuff 11 at the large end of the center portion 10 and a cuff 14 at the small end of the center portion 10. The cuffs 11 and 14 extent about two inch along the outside of the tube in the direction of the axis of the tube. In a first embodiment, the cuffs 11 and 14 are folded around the end of the central portion 10. The material that forms cuff 11 extents about an inch and a half along the inside of the tube and the material that forms cuff 14 extents about a quarter of an inch along the inside of the tube. Seams 11A, 11B, 14A and 14B (and in some embodiments additional seams) hold the cuffs 11 and 14 to body 10. A seam 21 (see FIG. 4) extends along the entire length of the device.

In the first embodiment, the small end has a diameter of two and a quarter inches, the large end has a diameter of eight inches, the overall length is twenty and a half inches and the cuffs 11 and 14 extend on the outside of the center element 10 for two inches in the direction of the axis of the tube. In the first embodiment, the material that forms the cuff is folded over and extends on the inside of the central portion.

In the first preferred embodiment, the main center part 10 of the device is made of PVC Coated 600 Denier Polyester Duck cloth. Such material is commercially available and distributed by the Nassimi Corporation of New York. The cuffs are made of ⅛ inch thick polyester Fleece material which is marketed under the name "Polartec 200 solids Double Velour Polyester by Maiden Mills Inc. The color of the central portion 10 is orange and the cuffs are black. Any desired colors that provide a pleasing or appropriate color can be used. The cuffs can be made of any material that provides a pleasing appearance; however, in some embodiments the semi-flexible material that forms the cuffs adds stiffness to the ends of the device.

In one alternate preferred embodiment, the central part of the device is made from PVC vinyl cloth that has a felt backing. The vinyl layer is about 0.05 inches thick. The felt backed vinyl material which forms the main part of the tube of this alternate embodiment is commercially available. It is 0.05 thick vinyl made by Rockland Mills, which is a division of Rockland Industries, Inc. U.S.A.

In some embodiments the material that forms the cuffs extends for an inch or more along the inside on the tube. In other embodiments, the material that forms the cuff extends for a shorter distance along the inside of the tube. In some embodiments the material that forms at least one of the cuffs is not folder over the end and it does not extend along the inside of the tube. Other embodiments have cuffs of various other sizes. A sufficient number of seams should be provided to hold the cuffs to the central potion 10 on both the inside and outside of the tube.

In one alternate embodiment the cuff 14 is not folded around the small end of the tube. The cuff 11 extends for one and three quarters inch on both the inside and outside of the central portion 10. In this alternate embodiment, the fabric forming the center portion 10 and cuff 14 is folded back under the cuff 14 at the small end so that the raw edge of the fabric on both parts is not visible.

The diameter of the small end of the device is generally the size of a mouth piece and the diameter of the large end is generally three or four times larger than the small end.

An important characteristic of the material that forms the main body of the device is that it has the property that it reflects sound so that the device can be used to amplify sound and to serve as a hearing aid. The outside surface of the material can have any characteristics that provide a desired appearance. Letters or words that provide a message or logo can be screen printed, painted, sewn or glued to the outside surface.

The cuffs serves several functions. They add to the appearance of the device and they stiffens the ends so that when the device is held as shown in FIGS. 2, 4, 6 and 8, the ends are approximately circular. When the device is worn as a hat as shown in FIG. 1, the facing on the large end helps hold the hat on the wearers head and it provides comfort to the user. It is noted that instead of cuffs, other techniques can be used to stiffen the ends and yet allow them flex so that the device can be folded. For example a piece of plastic material can be sewn on the inside of the ends. Such a stiffening device can be used with or without adding cuffs.

The desired property of the material used as a cuff and facing at the ends of the device are that it can fold and yet that it is stiff enough to hold the form shown in FIGS. 2, 4, 6 and 8. Furthermore, it needs to have a surface that provides comfort when worn as shown in FIG. 1. Polyester fleece and craft felt are only examples of material that have this property. Other types of cloth can also be used.

The material that forms the main body of the device is flexible enough that when the device is worn as a hat it bends as shown in FIG. 1 and it can be folded as shown in FIG. 3. The material that forms the cuffs at the ends of the device is pliable so that the ends can be folded as shown in FIG. 3. The ends of the device need be stiff enough so that they stay open when the device is held as shown in FIGS. 2 and 4. Two layers of polyester fleece or craft felt sewn as shown has been found to be sufficient; however, for added stiffness additional layers can be added. Various other material that has similar properties can also be used. In other embodiments, a single layer of fleece or craft felt turned under at the ends has been found to have sufficient stiffness.

It is noted that the device as shown in FIG. 2 includes a poster like logo "OSU". Such branding can be an important element for devices used at events such as sporting events. The visual material can consist of any information conveying artifacts including names, symbols and pictures. The information conveying artifact can be painted or screen printed on the surface of the device or otherwise adhered to the surface. The information conveying artifact can be positioned on the central portion 10 or on cuffs 11 or 14.

At an event such as a football game or at other times, the device can be worn as a cap, and then when appropriate used as a sound amplifying device. It is noted that sporting events and other crowded situations are often noisy, making it hard to hear and be heard. When used as shown in FIG. 2, the invention facilitates making ones voice heard in a particular direction. When used as shown in FIG. 4, the invention facilitates hearing voices and/or sounds originating in a particular direction.

FIG. 6 shows the device used as a safety cone. Parties are often held in parking lots of stadiums where sporting events are held. Frequently in such areas cones are needed to control traffic flow. The first embodiment of the invention serves this function.

It is noted that the body of the device is sufficiently stiff that the cone can stand of its own accord as shown in FIG. 6 and such that when held at the ends as shown in FIGS. 2 and 4, it does not collapse. Yet it can be folded as shown in FIG. 3. Such a degree of stiffness is provided by the material that forms the central portion 10. The end pieces are stiff enough that they maintain a round shape when held as shown in FIGS. 2 and 4. However, they can be folded as shown in FIG. 3. Such a degree of stiffness is provided by the fleece or craft felt used to manufacture end cuffs 11 and 14 of the first embodiment. The degree of stiffness that is required such that the device will retain a tubular shape when held at one point at either end as shown in FIGS. 2 and 4 is herein referred to as semi-flexible. Various other semi-flexible materials instead of the material used in the first embodiment of the device can be used in place of the specific materials described above.

Figure 5:
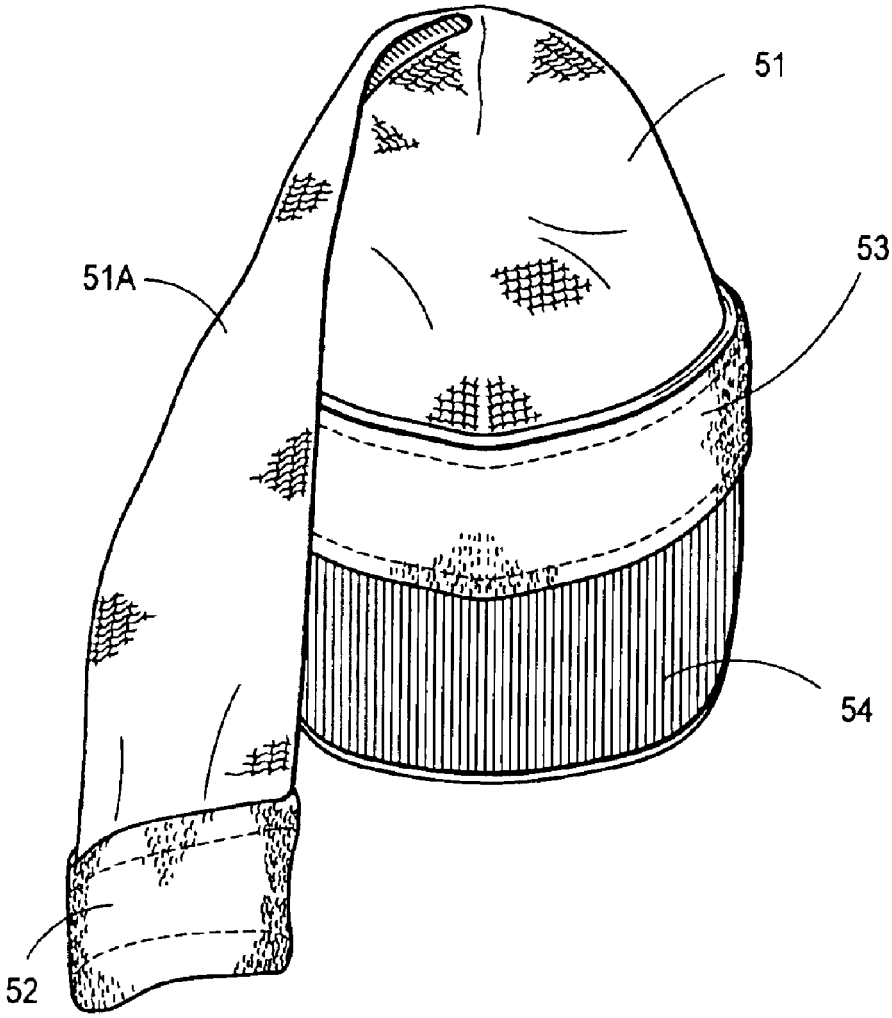
FIG. 5 illustrates an alternate embodiment of the invention which includes a visor.
Figure 7:
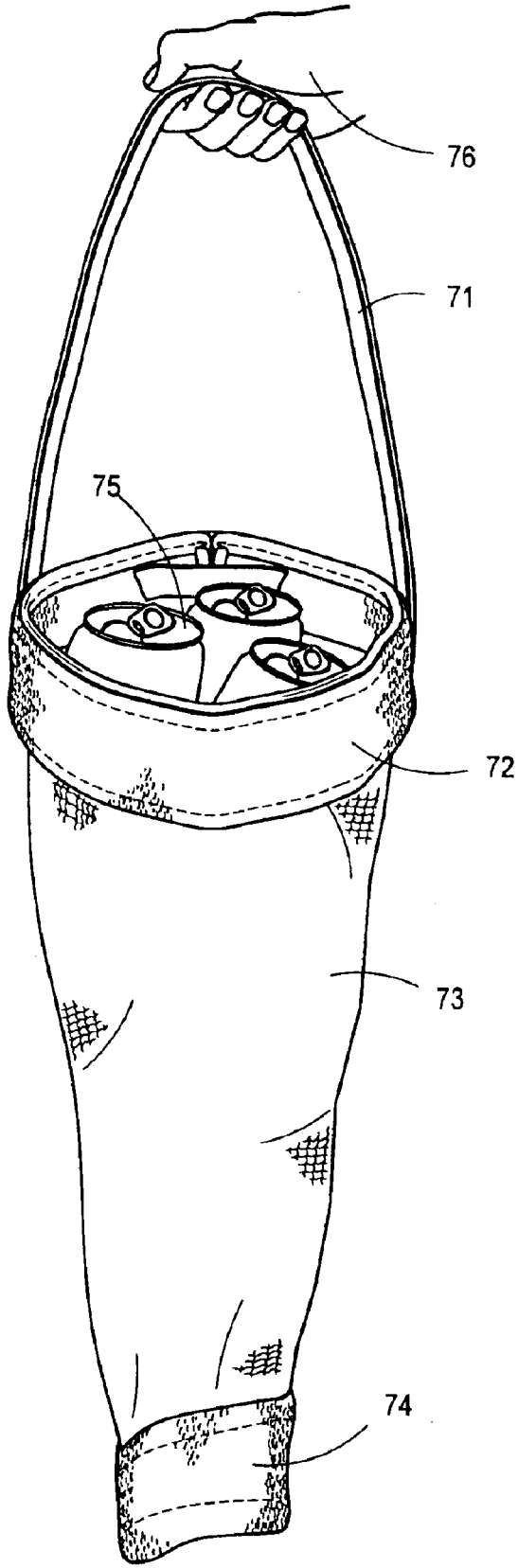
FIG. 7 illustrates an alternate embodiment which includes a carry strap.

An alternate embodiments the invention shown in FIG. 5 has a "base ball cap type" visor 54 to shade the use's eyes from the sun. Another embodiment the invention shown in FIG. 7 includes a strap 71. With the strap the device can be used to carry material. The strap can also be used to help keep the device on the wearers head. In still another embodiment of the invention (not shown in the Figures) the large end of the device is sufficiently large that the wearer can place the device over a conventional headgear. With such an embodiment, the large end should be small enough so that the device fits smugly over the other headgear.

The small end is approximate the size of a user's lips. If the device is made in a size for children, both ends could be smaller than the size specified for the first embodiment. The large end can be made in a variety of the sizes that are normally used for headgear. The device can be made in a wide variety of sizes. It can even be made small enough to fit on a doll's head. Such a device would be about eight inches long, one and a half inches wide at the small end and four inches wide at the large end. It could still serve as a megaphone although not as effectively as the large size device.

Figure 8:
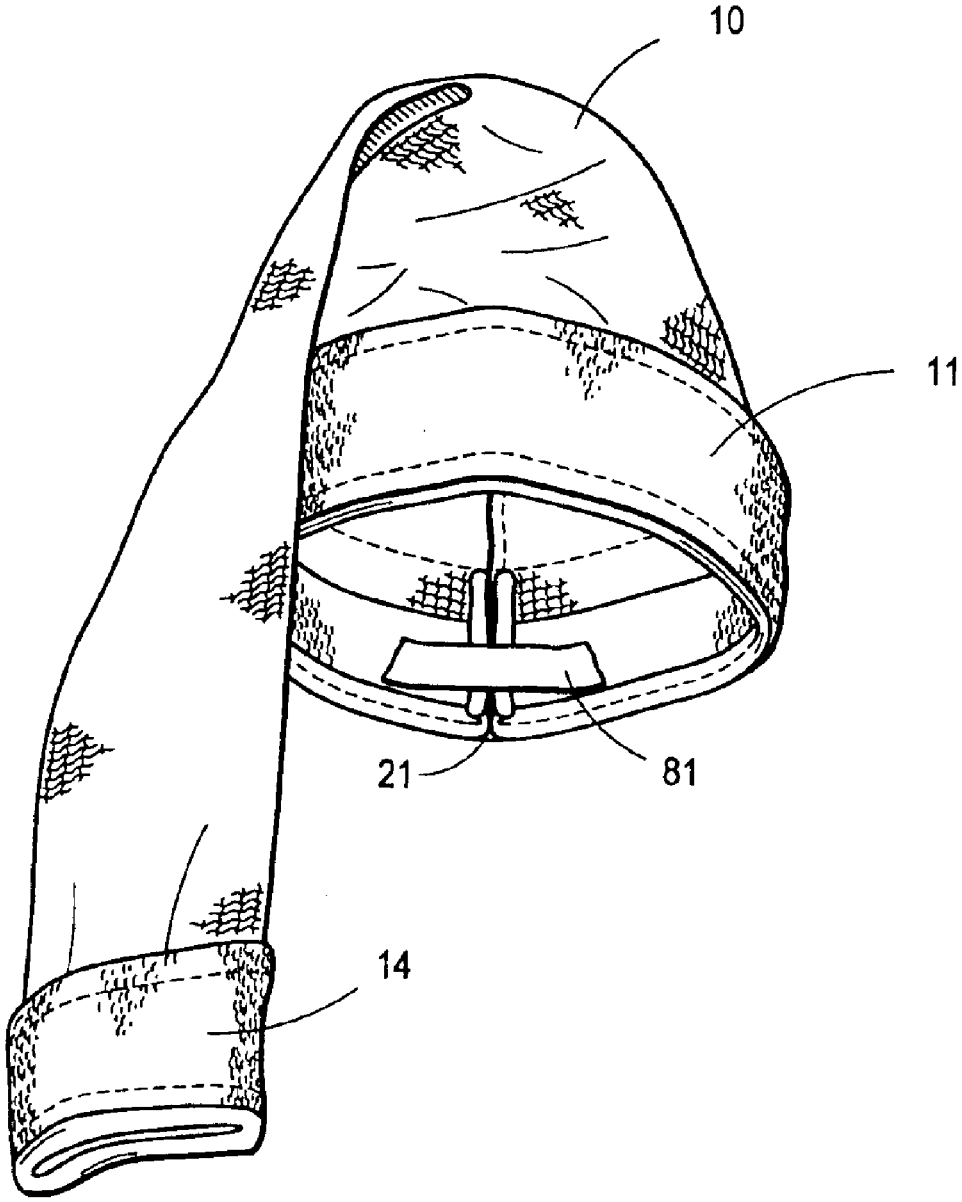
FIG. 8 shows a different view of the first embodiment of the invention.

As shown in FIG. 8, the device can include an expandable elastic strap 81 which will hold the hat to a user's head when the hat is applied to a users head and strap 81 is expanded. In one preferred embodiment strap 81 is an elastic strap three and a half inches long which is sewn to the underside of the cap, on half inch from the edge of the cap.

In one embodiment, a thin plastic strip is sewn into the cuff in order to add stiffness. The plastic strip is sewn between the material that forms the cuff and the material that forms the main body 10. Any appropriate number of sewn seems can be used to hold the cuff and the plastic stiffening material if such is used.

In one alternate embodiment of the invention, the vinyl surface (i.e. the sound reflecting surface) is placed on the outside and the felt surface is on the inside. This embodiment was found to operate satisfactorily; however, the sound amplifying properties were less than with other embodiments where the sound reflecting surface was on the inside of the device.

In one embodiments vinyl is used to form the main tubular structure and in another embodiment, nylon pack cloth is used. Vinyl generally provides better sound amplification qualities than nylon pack cloth and thicker vinyl provides better sound amplification than thinner vinyl. However, nylon pack cloth is satisfactory. The main tubular structure can alternatively be made of paper or any material that has sound reflecting properties. While the device need not be foldable as is the first embodiment, if the device is to be folded the material should be pliable enough to both fold and conform to the shape of the wearer's head.

In one alternate embodiment the device is approximately 25 inches long with stitching down the middle of the center tubular portion. The large end is approximately 8 inches in diameter with fiberglass rod sewn in to create a spherical shape to help keep it open. The small mouth end is approximately 1¾ inches in diameter with a 1¼ inches long plastic pipe that is duct taped on to keep the small end open. The material is 420D PACKCLTH 1-½ u-NE. Yel from Seattle Textile Company.

Still another embodiment is approximately 25 inches long with stitching down middle. The large end is made of black Frontier vinyl 100% PVC faced 100% poly backed material made by Rockland Mills a division of Rockland Industries, Inc. U.S.A.. The cuff band is approximately 4 inches wide and 8 inches in diameter with ¾ inch wide plastic strip from corner mold sewn inside to keep it somewhat spherical and stitched several times. The small end is made of the same material approximately 2 inches wide with 2 inch rubber spud washer sewn into it for support also and sewn several times. The middle section is approximately 18 inches long made out of burgundy vinyl 100% PVC faced 100% polyester backed.

In yet another embodiment the material is turned inside out so the PVC vinyl face is inside and the poly back is outside to give it a fuzzy plush look. The middle section is approximately 16½ inches long and made of white Pioneer vinyl from Rockland. The big and small ends have the PVC face folded and sewn on outside.

In yet another embodiment the device is approximately 21 inches long with stitching down the middle. The large end is approximately 7 inches in diameter and the cuff is approximately 2 inches wide, made of Red 100% polyester craft felt folded over several times and stitched several times and lapped over the middle section for more stiffness. The small mouth end is approximately 2¼ inches in diameter and the cuff is approximately 2 inches wide and made of red craft felt 100% polyester and folded several times and stitched several times being lapped over the middle section to make a stiffer end. The middle section is approximately 16½ inches long on the outside and approximately 20 inches long on the inside. It is made of white Pioneer vinyl 100% PVC faced 100% poly backed with vinyl on inside and poly back on out side to give it that fuzzy look.

In yet another embodiment the device is approximately 16 inches long with stitching down the middle. The large end is approximately 8 inches in diameter with a cuff approximately 3 inches wide. The cuff is made of black 100% polyester craft felt folded several times and sewn several times over middle section for stiffness. It has a red Velcro type strap approximately ¾ inch wide and approximately 3½ inches long sewn on. The velcro allows one to add removable emblems and the likes. The small end is approximately 2¾ inches in diameter. The cuff at the small end is approximately 2½ inches wide folded several times and sewn over middle section several times for stiffness. The middle section is approximately 10½ inches long outside and approximately 16 inches long on the inside and is made of 420D PACKCLTH 1-1/2u NE Yel.

In yet another embodiment the device is approximately 20 inches long with large end approximately 8½ inches in diameter with small end approximately 1¾ inches in diameter.

Another embodiment of the invention has an over all length is approximately 20 inches. The large end has a diameter of approximately 8 inches, and the little end has a diameter of approximately 1½ inches. A felt cuff on the large end is about 3 inches wide with 5 stitching lines. The cuff is black and it is made out of 100% polyester craft felt that has been folded over 2 times and sewn to the middle section. The middle section is made of 420D PACKCLTH 1-1/2u-NE.Yel from Seattle Textile Company. It is neon yellow and has a continuous taper. The cuff at the small end is made of 100% polyester craft felt and has been doubled over and has been face stitched 3 times. The cuff is black and is approximately 2½ inches wide. The megaphone hat has been sewn from end to end and to make it carry the noise it is made out of a somewhat non-sound absorbing material.

Another embodiment includes a stiffening element made of plastic or rope in the cuff at each end to keep the ends some what spherical in shape. The device can include an elastic band at the mouth end. The device can include a support handle connected to the large end to facilitate holding the device. The device can be sewn from a variety of materials sewn together in bands or colors of same material. The strips can be cut and sewn length ways or around the tube.

Another embodiment is approximately 23 inches long with stitching down the middle. The large end is approximately 7½ inches in diameter with a ¾ inches wide plastic band made from a plastic corner mold that was cut down the middle and made into a hoop and sewn into the fabric. The fabric is 100% polyester craft felt and is approximately 3½ inches wide and sewn several times and is black. The small mouth end is same material and color and is approximately 3 inches wide with a 2 inch rubber spud washer sewn into it for stiff pliable end and kept in a spherical shape and has been sewn several times. The middle section is approximately 18 inches long and is made of 100% polyester craft felt colored orange and all three sections are sewn together.

It is noted that t a user can put hands and lower arms inside the tube to keep warm. pockets can be provided along the device for pictures, cards, or advertising material. Battery operated flashing lights can be added to draw attention to the device.

Springy pliable stiffeners can be added to make the device less pliable. Pom-pom tassels can be added at the small end (or elsewhere) to make the device a pom-pom rooter cap. The device can be folded flat and used as a pennant. A fastening snap or a Velcro strap can be added to hold the device in a folded or rolled up configuration. The device can be made with a thin central portion so that it can be used as a necktie. The device can be made from a washable material so that it can be laundered.

The device can be decorated with added material so that it looks like a witch hat, a santa hat, a pirate hat, etc.

Earmuffs can be attached to the hat. The device can be decorated with Christmas colors and used as a Santa stocking.

A zipper can be sewn into the device along its entire length so that the device an be unzipped and made to lay flat. Such a device can be uses a chair seat cover, a blanket or it can be used as a wall pennant.

Figure 9:
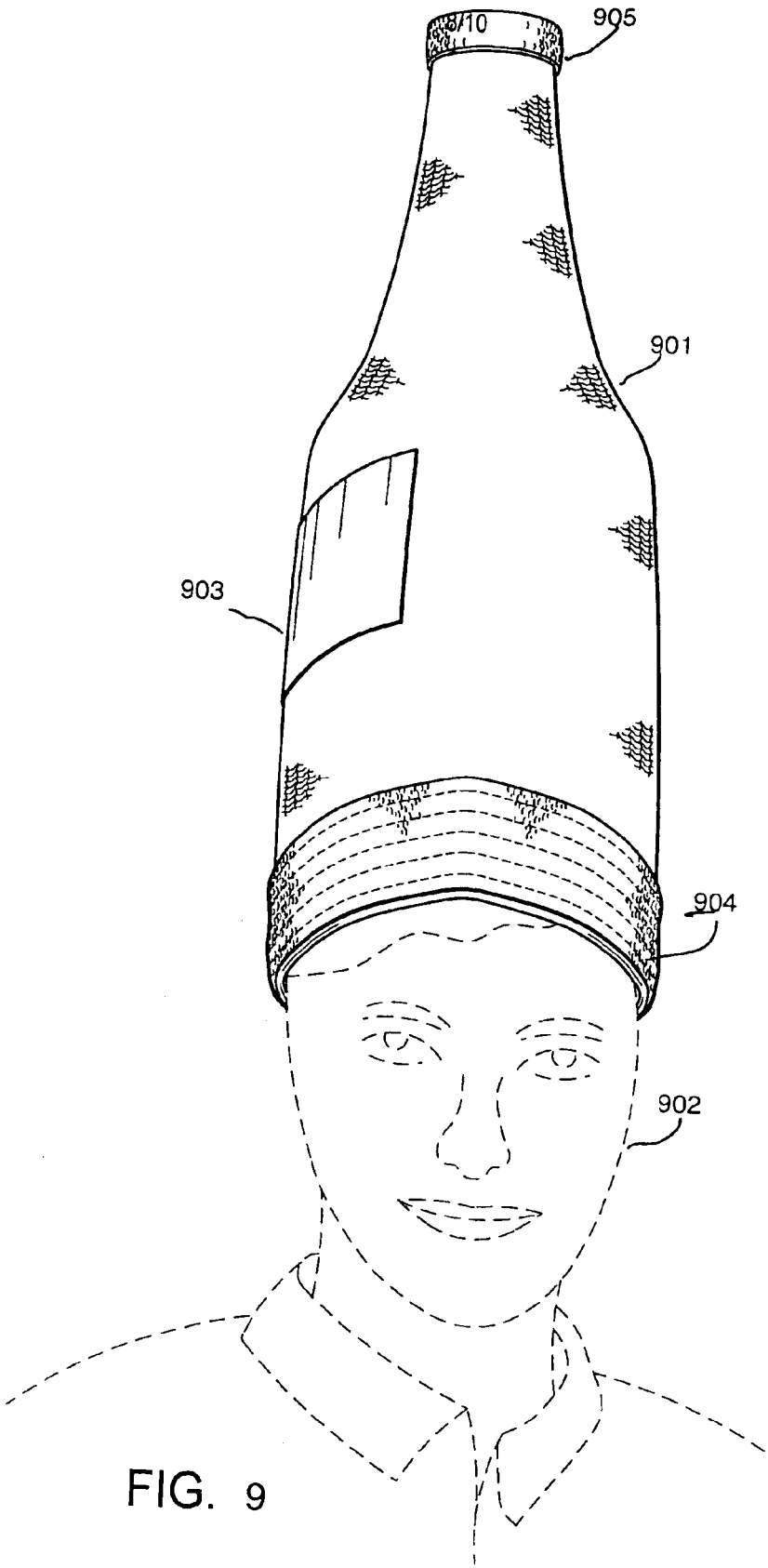
FIG. 9 is side view of another embodiment of the invention.
Figure 10:
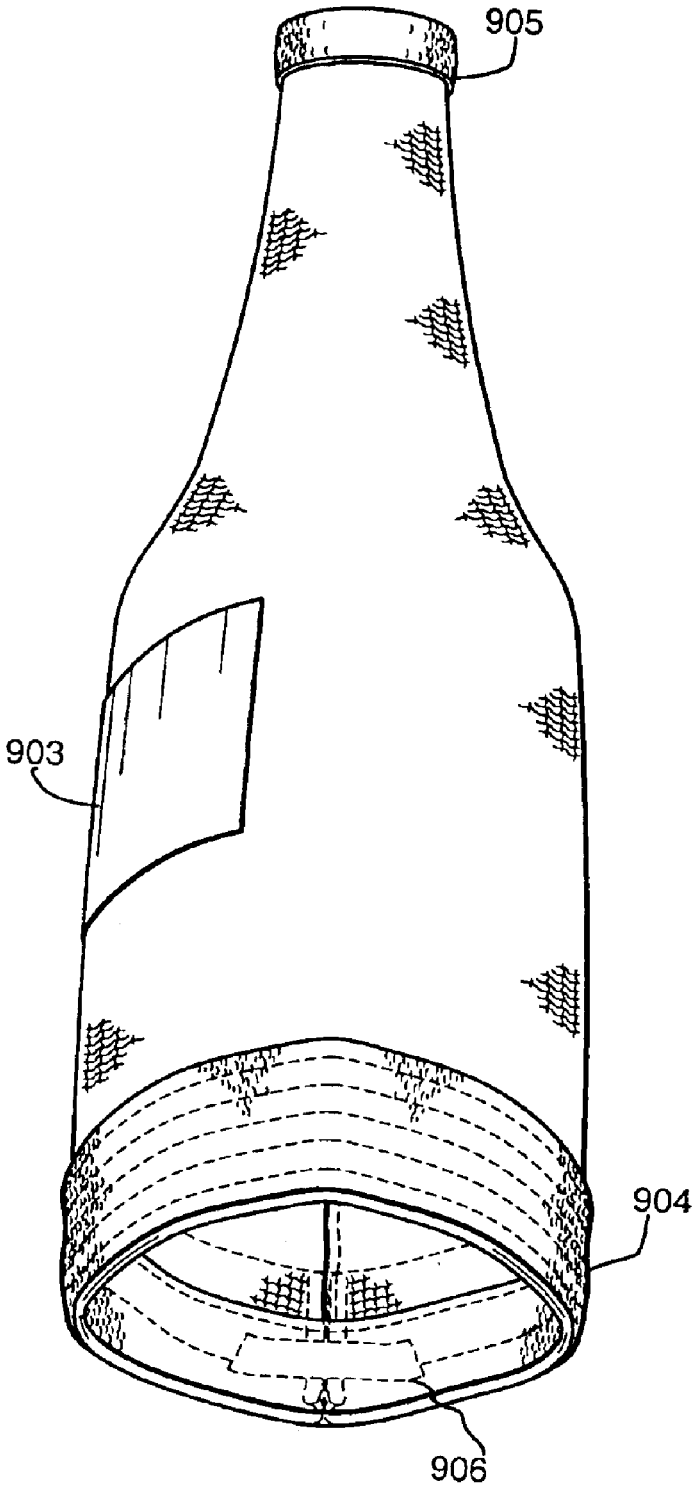
FIG. 10 is a perspective view which shows the inside of the large end of the embodiment shown in FIG. 9.
Figure 11:
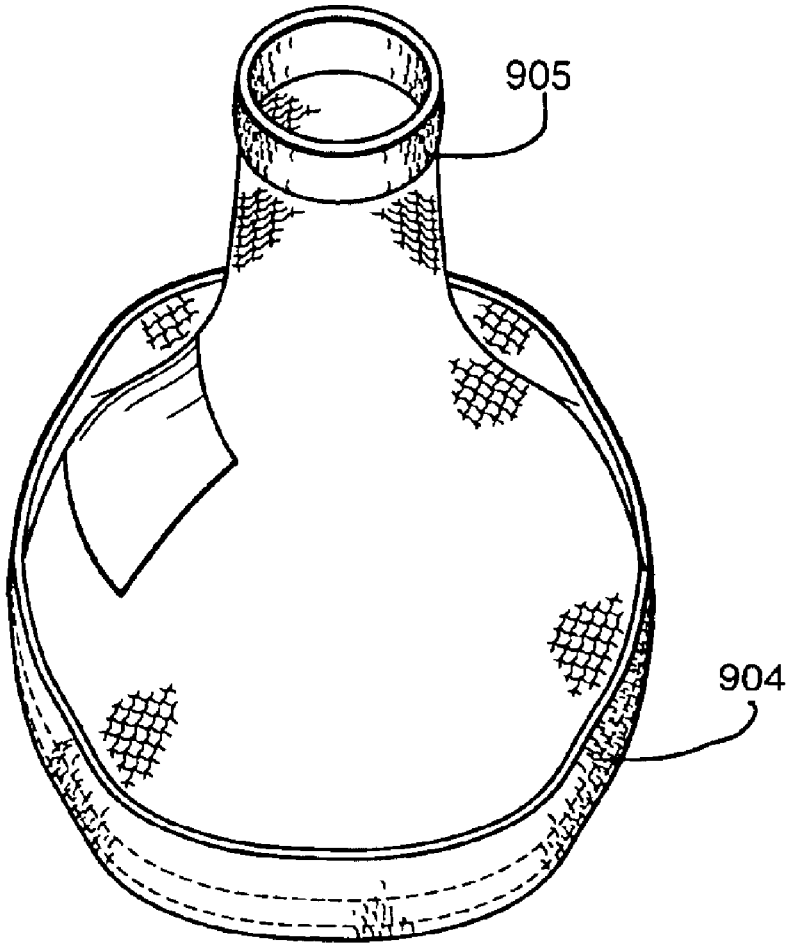
FIG. 11 is a top view of the embodiment shown in FIG. 9.

Still another embodiment of the invention is shown in FIGS. 9, 10 and 11. FIG. 9 shows the hat on a user head 902. FIG. 10 shows the inside of the large end of the hat and FIG. 11 shows the inside of the small end of the hat. In this embodiment of the invention the central portion 901 of the hat does not taper uniformly from the small end 905 to the large end 906. Instead the hat has a "beer bottle" shape.

The small end 905 has a cuff to add stiffness and to provide an enhanced appearance. Likewise the large end 904 includes a cuff for the same purposed. The cuffs on ends 904 and 905 can be similar to the cuffs on the previously described embodiments.

There is an area 903 which is designed to contain lettering. This section can be any shape. In the particular example shown the section 903 is the shape of a "beer bottle" label. The large end 905 includes an elastic strap 906 which fits the hat to a user's head and which hold the hat on a user's head. The size of ends 905 and 906 can be similar to the size of the ends on the previously described embodiments. This embodiment can be made of material similar to that described for the previously described embodiments.

It is noted that in order to use the device to amplify sound, the inside of the device must have sound reflecting properties. A smooth hard surface (such as the surface of vinyl) reflects sound and does not absorbs sound, thereby providing the device with sound amplifying properties. Vinyl has a smooth relatively hard surface with good sound reflecting properties. It provides a good inside surface for the device. The outside of the device can be soft and the outside surface material can be selected for aesthetic purposes. Overall the material from which the center tubular portion is constructed in the various embodiments can be described as flexible or soft and pliable, but the inside surface of the material must have sound reflecting properties.

In order for the inside of the central tubular portion to reflect sound, it should be made of non-permeable material (for example vinyl). A very simple test to determine if a material is permeable to air is to hold it against one mouth and to try to blow air through the material. Material that one can not breath through is considered to be impermeable to air. Vinyl is non-permeable or impermeable to air as the terms are used herein.

It is noted that in some situations the device serves primarily as a flexible megaphone. The advantage of a flexible megaphone is that it can be folded so that it can be easily carried in a pocket or purse. In some situations the device will be used as a flexible megaphone when extended and as a pennant or cushion when the tubular section is collapsed.

The device can be constructed with or without a zipper along it's length. Such a zipper allows the tubular structure to be opened and into a larger single layer unit, that can be used as a blanket or pennant. It is noted that as used herein the term "zipper" is meant to mean any type of device which can fasten two pieces of cloth together in a removable fashion.

While various embodiments have been shown and described, various other changes in form and detail can be made without departing from the spirit of the invention. The scope of applicant's invention is limited only by the appended claims.

We claim:

1. A hat comprising a round tubular center portion formed of flexible material that has an hard inside surface which reflects sound, said center portion having a large end and a small end, the size of the large end is such that the large end fits on a wearer's head, the size of the small end is such that the small end fits over a user's mouth, whereby said hat can fold when placed on a user's head and when held in an extended shape it can be used as a megaphone for sound amplification.

2. A hat recited in claim 1 including a poster-like message display panel on said center portion.

3. The hat recited in claim 1 including cuffs at both ends of said center portion.

4. The hat recited in claim 1 wherein said center portion is made of polyester duck cloth.

5. The hat recited in claim 1 wherein said flexible material in impermeable to air.

6. The hat recited in claim 1 made of flexible material that can maintain a tubular shape when held at one point at the ends of the tube and which can be folded lengthwise into a small shape.

7. The device recited in claim 1 wherein said tubular center portion is soft and pliable.

8. A megaphone comprising, a tubular central portion made of flexible material which has a smooth and hard inside surface, said tubular central portion having a small end and a large end, said flexible material being able to maintain a tubular shape when held at one point on the large end and one point on the small end, said smooth and hard inside surface being able to reflect sound such that said megaphone can be used to amplify sound.

9. The megaphone recited in claim 8 wherein said flexible material with a smooth and hard interior surface is vinyl cloth.

10. The megaphone recited in claim 8 wherein said small end approximates the width of a users mouth.

11. The megaphone recited in claim 8 wherein the large end is approximately the size of a wearer's head.

12. The megaphone recited in claim 8 wherein the large end has a felt cuff which extends around the end of the central portion to make the device comfortable when worn.

13. The megaphone recited in claim 8 including an information conveying artifact on the central portion of the device.

14. The megaphone recited in claim 8 including an information conveying artifact on an outside surface of the device.

15. The megaphone recited in claim 8 wherein the central portion is made from material that has sound reflecting properties on the inside surface and aesthetic properties on the outside surface.

16. The megaphone recited in claim 8 where the center portion is made of PVC vinyl cloth that has a felt backing.

17. The megaphone recited in claim 12 wherein said cuff is are made from craft felt.

18. A multi purpose device comprising, a tapered tubular central portion with a small open end and a large open end, said central portion being made of flexible material which has a smooth hard interior surface, such that said central portion can maintain a tubular shape when held at one point on the large end and one point on the small end and such that said interior surface reflects sound such that said device can be used to amplify sound, whereby said device can be used as a hat, a megaphone or folded to form a pennant.

19. The hat recited in claim 1 including a sun visor.

20. The megaphone recited in claim 8 including a zipper along the entire length of the tubular portion such that said megaphone can be opened to form a single layer device that can be used as a blanket or as a pennant.

21. The megaphone recited in claim 8 wherein said tubular center portion is soft and pliable.

22. The megaphone recited in claim 8 wherein said tubular center portion is non-permeable to air.

* * * * *